US011375875B2

(12) United States Patent
Kim

(10) Patent No.: US 11,375,875 B2
(45) Date of Patent: Jul. 5, 2022

(54) ROLLER DEVICE AND DISHWASHER INCLUDING THE SAME

(71) Applicant: Samsung Electronics Co., Ltd., Suwon-si (KR)

(72) Inventor: Jin Doo Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 133 days.

(21) Appl. No.: 16/690,007

(22) Filed: Nov. 20, 2019

(65) Prior Publication Data

US 2020/0154976 A1 May 21, 2020

(30) Foreign Application Priority Data

Nov. 20, 2018 (KR) ..... 10-2018-0143594

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS 3,433,363 A * 3/1969 Clearman ..... A47L 15/505 211/41.8
3,761,153 A * 9/1973 Guth ..... A47L 15/507 312/351
5,345,959 A * 9/1994 Matteson ..... A47L 15/507 134/201
5,730,301 A 3/1998 Welch et al.
10,010,239 B2 7/2018 Nowell, Jr. et al.
10,292,567 B2 * 5/2019 Nowell, Jr. ..... A47L 15/4285
2008/0210275 A1 * 9/2008 Woo ..... A47L 15/507 134/165
2012/0074822 A1 * 3/2012 Oppel ..... A47L 15/507 312/228
2013/0125937 A1 5/2013 Baldwin et al.
(Continued)

FOREIGN PATENT DOCUMENTS

GB 2382630 A 6/2003
KR 10-2007-0039676 A 4/2007
(Continued)

OTHER PUBLICATIONS

International Search Report dated Mar. 24, 2020 in connection with International Patent Application No. PCT/KR2019/015965, 3 pages.
(Continued)

*Primary Examiner* — Benjamin L Osterhout

(57) ABSTRACT

A roller device having improved rolling performance and a dishwasher including the same. The dishwasher includes a cabinet including a washing tub, a basket provided inside the washing tub, a shaft unit coupled to the basket and including a shaft, a plurality of balls rotating along an outer circumferential surface of the shaft, and a roller rotatably coupled to the shaft and including a plurality of seating portions spaced apart from each other to seat the plurality of balls, wherein at least one of the plurality of seating portions receives two or more of the plurality of balls.

19 Claims, 9 Drawing Sheets

(56) References Cited

U.S. PATENT DOCUMENTS

| | | | | |
|---|---|---|---|---|
| 2015/0190034 | A1* | 7/2015 | Jeong | A47L 15/507 312/228.1 |
| 2018/0192852 | A1 | 7/2018 | Hansen | |
| 2018/0256006 | A1 | 9/2018 | Nowell, Jr. et al. | |

FOREIGN PATENT DOCUMENTS

| | | | |
|---|---|---|---|
| KR | 10-1838029 | B1 | 3/2018 |
| WO | 2010/124957 | A1 | 11/2010 |

OTHER PUBLICATIONS

Supplementary European Search Report dated Oct. 19, 2021 in connection with European Patent Application No. 19 88 8038, 5 pages.

* cited by examiner

ROLLER DEVICE AND DISHWASHER INCLUDING THE SAME

CROSS-REFERENCE TO RELATED APPLICATION

This application is based on and claims priority under 35 U.S.C. § 119 to Korean Patent Application No. 10-2018-0143594, filed on Nov. 20, 2018, in the Korean Intellectual Property Office, the disclosure of which is incorporated by reference herein in its entirety.

BACKGROUND

1. Field

The disclosure relates to a roller device having improved rolling performance and a dishwasher including the same.

2. Description of Related Art in general, a dishwasher is a device for washing tableware by injecting high-pressure washing water on the tableware, and may normally perform preliminary washing, main washing, rinsing, and drying.

In the preliminary washing process, washing water is injected without the addition of a detergent to remove dregs from the tableware, and in the main washing process, washing water is injected and at the same time the detergent is supplied by a detergent supply device so that the tableware may be washed.

In the rinsing process, washing water may be injected to wash off the detergent, and in the drying process, water remaining in the tableware may be removed.

A basket for receiving tableware may be provided in a washing tub in which the tableware are washed. In order for a user to conveniently put in or out tableware, the basket may be installed to withdrawn through a front surface of the washing tub. A roller device is installed at opposite sides of the basket to guide the movement of the basket.

In general, the basket at which the roller device is installed may be moved by rolling motion along a rail using a roller or the like. However, the method of moving the basket using only the roller may cause severe friction and noise.

A separate ball bearing may be additionally used in the roller to guide the basket. However, in the roller in which a separate ball bearing is used, the stricture for supporting the ball bearing may be vulnerable in durability, and the manufacturing cost thereof may increase.

SUMMARY

It is an aspect of the disclosure to provide a roller device including a plurality of balls and shafts improved to enhance the rolling performance of a roller, and a dishwasher including the same.

It is another aspect of the disclosure to provide a roller device improved such that a roller is provided with a seating portion capable of performing a retainer function together, and a dishwasher including the same.

It is another aspect of the disclosure to provide a roller device including a coupling member improved such that a roller, a plurality of balls, and a shaft are firmly coupled to each other, and a dishwasher including the same.

Additional aspects of the disclosure will be set forth in part in the description which follows and, in part, will be obvious from the description, or may be learned by practice of the disclosure.

In accordance with an aspect of the disclosure, a dishwasher includes a cabinet including a washing tub, a basket provided inside the washing tub, a shaft unit coupled to the basket and including a shaft, a plurality of balls rotating along an outer circumferential surface of the shaft, and a roller rotatably coupled to the shaft and including a plurality of seating portions spaced apart from each other to seat the plurality of balls, wherein at least one of the plurality of seating portions receives two or more of the plurality of balls.

The shaft may include a first shaft configured to allow the plurality of balls to rotate, and a second shaft having a step outward from the first shaft to prevent the plurality of balls from being separated from the plurality of seating portions.

The first shaft may include a cylindrical shape such that the plurality of balls rotates in point contact with the first shaft.

An outer circumferential surface of the first shaft with which the plurality of balls is in contact may form a straight line.

The roller may include a wheel portion configured to roll along opposite side portions of a lower plate of the washing tub, and a stopper portion forming a step outward from the wheel portion to prevent the wheel portion from being separated from the opposite side portions.

The plurality of seating portions may be recessed outward from an inner circumferential surface of the wheel portion and may constitute a groove opened in a direction of directing to the stopper portion to prevent the plurality of balls from being constrained to the plurality of seating portions.

The roller may further include a bottom portion bent from the wheel portion to cover an outer side of the roller, and the bottom portion may include a placement hole configured such that the plurality of balls is spaced apart from an inner surface of the bottom portion and seated in the plurality of seating portions.

The placement hole may be connected to the plurality of seating portions.

The shaft unit may further include a shaft body coupled to the basket, and the shaft may protrude from the shaft body and may be fixed to the shaft body such that the plurality of balls and the roller rotate around the shaft.

The shaft unit may include a basket coupling portion configured to be coupled to one of the plurality of horizontally arranged horizontal wires constituting the basket, an anti-rotation portion configured to interfere with the other one of the plurality of horizontal wires to prevent the shaft unit from rotating around the horizontal wire coupled to the basket coupling portion, and an anti-movement portion configured to interfere with one of a plurality of vertically arranged vertical wires constituting the basket to prevent the shaft unit from moving along the plurality of horizontal wires.

The dishwasher may further include a coupling member configured to connect the roller and the shaft, wherein the coupling member may include a base portion, a body portion protruding from the base portion, and a head portion extending from the body portion.

The roller may further include a boss including a coupling hole into which the coupling member is inserted.

The shaft may include an insertion hole into which the boss is inserted.

The boss may include a head stopper configured to catch the head portion inserted into the coupling hole, and the shaft may include a base stopper configured to catch the base portion inserted into the insertion hole.

A gap between an outer surface of the boss and an inner surface of the insertion hole may be larger than a gap between an outer surface of the shaft and an inner surface of the plurality of seating portions and the plurality of balls seated in the plurality of seating portions.

In accordance with another aspect of the disclosure, a dishwasher includes a cabinet including a washing tub, a basket provided inside the washing tub, and a roller device configured to withdraw the basket from the washing tub, wherein the roller device includes a shaft unit including a shaft, a plurality of balls configured to rotate along an outer circumferential surface of the shaft, and a roller including a wheel portion configured to be rotatable about the shaft and a seating portion having an opened end to prevent the plurality of balls from being constrained and recessed outward from an inner circumferential surface of the wheel portion, and wherein an outer circumferential surface of the shaft with which the plurality of balls is in contact forms a straight line.

A plurality of the seating portions may be provided to be spaced apart from each other, and at least one of the plurality of seating portions may receive two or more of the plurality of balls.

In accordance with another aspect of the disclosure, a roller device includes a plurality of balls, a shaft unit including a shaft including a cylindrical shape such that the plurality of balls rotate along an outer circumferential surface thereof, and a roller rotatably coupled to the shaft and including a plurality of seating portions spaced apart from each other to seat the plurality of balls, wherein two or more of the plurality of balls is seated in the plurality of seating portions, respectively.

The roller device may further include a coupling member configured to connect the roller and the shaft.

The roller may further include a boss including a coupling hole into which the coupling member is inserted, and the shaft may include an insertion hole into which the boss and the coupling member are inserted.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
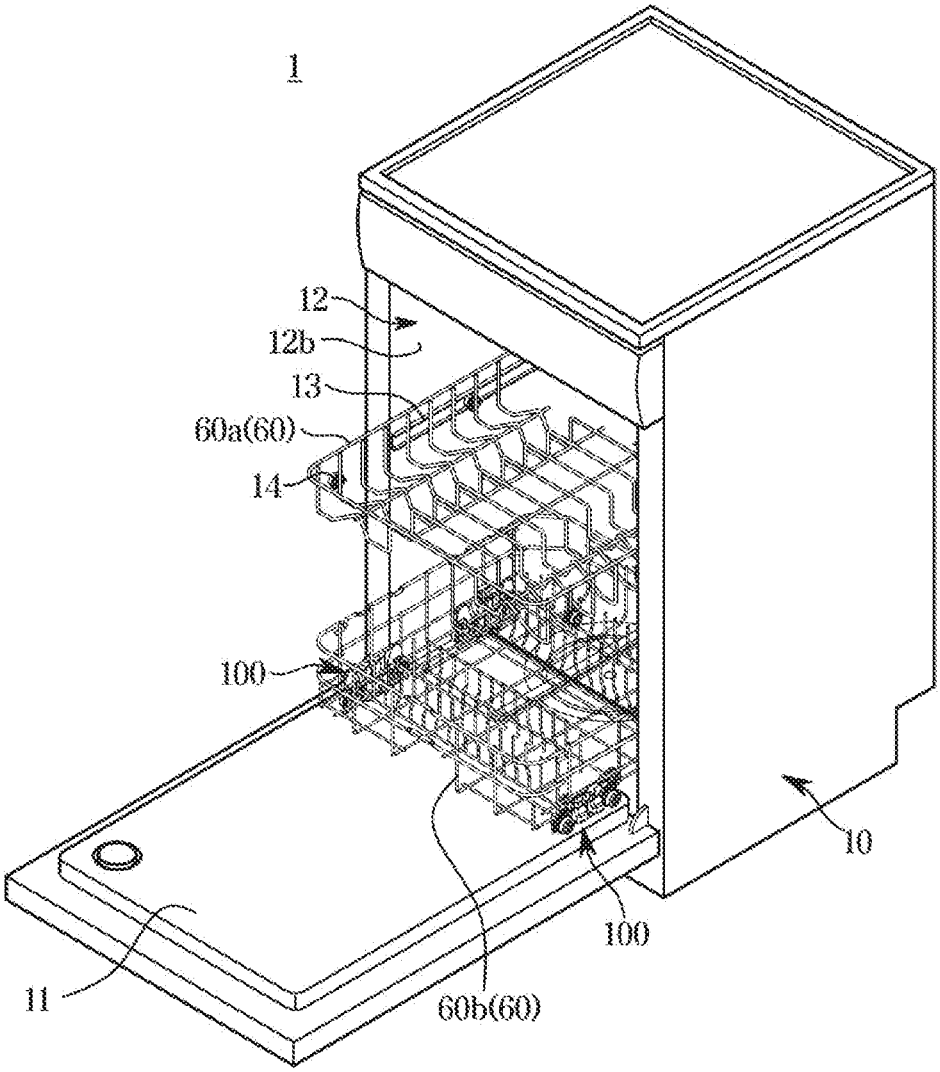
FIG. 1 illustrates a perspective view of a dishwasher according to the disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device, The embodiments described herein and the configurations shown in the drawings are only examples of embodiments of the disclosure, and various modifications may be made at the time of filing of the disclosure to replace the embodiments and drawings of the present specification.

Like reference numbers or signs in the various figures application represent parts and components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" or "has" are intended to indicate that there are features, numbers, steps, operations, elements, parts, or components thereof described in the specification, and do not exclude the presence or addition of one or more other features, numbers, steps, operations, elements, parts, or components thereof.

It will be understood that although the terms "first," "second," etc. may be used herein to describe various components, these components should not be limited by these terms, and the terms are only used to distinguish one component from another.

For example, without departing from the scope of the disclosure, the first component may be referred to as a second component, and similarly, the second component may also be referred to as a first component. The term "and/or" includes any combination of a plurality of related items or any one of a plurality of related items.

In addition, directions such as "front," "rear," "upper," "lower," etc. used in the present specification are defined based on the drawings, and the shape and position of each component are not limited by these terms.

Hereinafter, embodiments of the disclosure will be described in detail with reference to the accompanying drawings.

A roller device according to the disclosure may be applied to household appliances such as a basket of a dishwasher and a basket of an oven, and all the products that move in rolling motion such as furniture drawers. Hereinafter the roller device according to the disclosure will be described based on an example applied to the dishwasher.

Particularly, in the case of the basket of the dishwasher, the front of the basket may be lifted to have a predetermined inclination in order to prevent water remaining inside the washing tub from leaking to the outside.

Therefore, in general, in a case where the friction force of the roller is reduced by adding a separate ball bearing to the roller so that the roller performance is excessively enhanced, the basket may not be maintained in a withdrawn state and may be retracted back into place by the inclination. Accordingly, the user may be inconvenienced when putting tableware into the basket or taking the tableware out of the basket.

Therefore, there may be a need to use a roller capable of rolling motion with an appropriate friction force such that the basket of the dishwasher may be maintained in the withdrawn state.

Figure 2:
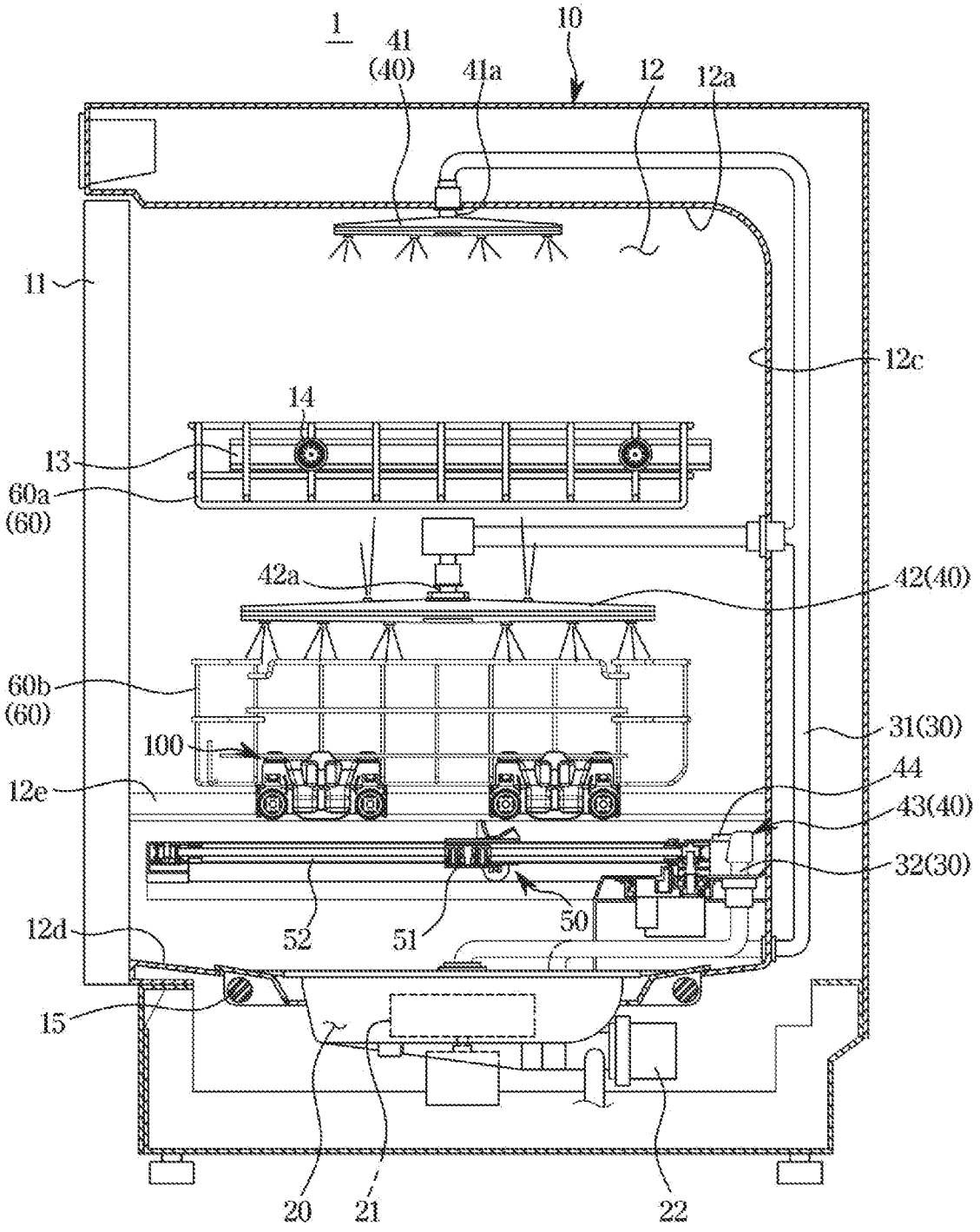
FIG. 2 illustrates a cross-sectional view of the dishwasher according to the disclosure.

FIG. 1 illustrates a perspective view of a dishwasher according to the disclosure, and FIG. 2 illustrates a cross-sectional of the dishwasher according to the disclosure.

As illustrated in FIGS. 1 and 2, a dishwasher 1 according to the disclosure may include a cabinet 10 forming an outer appearance and a washing tub 12 provided inside the cabinet 10.

The cabinet 10 may be formed in a box shape. However, the shape of the cabinet 10 is not limited thereto, may be formed in the shape of a cylinder or a polygonal column, and may be formed in a box shape of a polyhedron other than a hexahedron. In addition, the cabinet 10 may be formed in various shapes that may be applied as an external shape.

The washing tub 12 may be provided in a substantially box shape and may include a front surface open to put into and out tableware. The open front surface of the washing tub 12 may be opened and closed by the door 11. The door 11 may be rotatably coupled to the cabinet 10.

The washing tub 12 may be formed in a shape corresponding to the outer shape of the cabinet 10. The washing tub 12 may be formed in a box shape, but the shape of the washing tub 12 is not limited thereto.

The washing tub 12 may be formed in the shape of a cylinder or a polyhedral column and may also be formed in a box shape of a polyhedron other than a hexahedron. On the other hand, the washing tub 12 is not necessarily formed in a shape corresponding to the outer shape of the cabinet 10.

The washing tub 12 may include an upper plate 12*a* constituting an upper surface of the washing tub 12, opposite side plates 12*b* constituting side surfaces of the washing tub 12, a rear plate 12*c* constituting a rear surface of the washing tub 12, and a lower plate 12*d* constituting a lower surface of the washing tub 12.

The door 11 may rotate in a predetermined direction and open and close the washing tub 12.

One end of the door 11 may be provided with a hinge to rotate the door 11 in the predetermined direction.

The door 11 may be provided in the front of the washing tub 12, and a user may open the door 11 to put the tableware into and out of the washing tub 12. The door 11 may be provided with a handle so that the user may easily open and close the door 11.

The dishwasher 1 may include a basket 60 provided inside the washing tub 12 to receive the tableware and a rail 13 to support the basket 60. The basket 60 may include wires 61, 62, 63 (refer to FIG. 3) to allow the washing water to pass through without remaining.

The basket 60 may include an upper basket 60*a* and a lower basket 60*b*. The upper basket 60*a* may be supported by the rail 13, and the lower basket 60*b* may be supported by opposite side portions 12*e* of the lower plate 12*d*.

The upper basket 60*a* and the lower basket 60*b* may be configured to be slidable back and forth through the rail 13 and the opposite side portions 12*e* of the lower plate 12*d* in the washing tub 12.

The dishwasher 1 may include a sump 20 to collect and store the washing water, and a supply pipe 30 configured to supply the washing water to an injecting device 40. The sump 20 may be provided with a washing pump 21 for pumping the stored water into the injecting device 40.

The injecting device 40 may include a first injecting, device 41 provided above the upper basket 60*a* a second injecting device 42 provided between the upper basket 60*a* and the lower basket 60*b*, and a third injecting device 43 provided below the lower basket 60*b*.

The first injecting device 41 may be configured to rotate about a first rotation shaft 41*a*, and the second injecting device 42 may be configured to rotate about a second rotation shaft 42*a*.

The first injecting device 41 may inject the washing water toward the tableware received in the upper basket 60*a*, and the second injecting device 42 may inject the washing water toward the tableware received in the upper basket 60*a* and the lower basket 60*b*.

The third injecting device 43 may be configured to be fixed to one side of the washing tub 12, unlike the first injecting device 41 and the second injecting device 42. The third injecting device 43 may inject the washing water in a substantially horizontal direction. Therefore, the washing water injected from the third injecting device 43 may not direct to the tableware.

The third injecting device 43 may include a nozzle 44 through which the washing water is injected. A plurality of the nozzles 44 may be provided. The plurality of nozzles 44 may be arranged in a line and spaced apart from each other by a predetermined distance approximately from one side surface to the opposite side surface of the washing tub 12.

The washing water injected in a substantially horizontal direction from the nozzle 44 of the third injecting device 43 may be changed in direction by a switching device 50 disposed inside the washing tub 12 and then may direct to the tableware received in the lower basket 60*b*.

The switching device 50 may be constrained to a guide rail 52 by a holder 51 and may be configured to be movable along the guide rail 52.

The supply pipe 30 may include a first supply pipe 31 configured to supply the washing water pumped by the washing pump 21 to the first injecting device 41 and the second injecting device 42, and a second supply pipe 32 configured to supply the washing water to the third injecting device 43.

A heater 15 to heat the washing water and a drain pump 22 to drain the washing water may be provided below the washing tub 12.

The basket 60 may be provided to be withdrawn through the front surface of the washing tub 12.

Accordingly, the dishwasher 1 may include a wheel 14 or a roller device 100 to guide the basket 60 to be withdrawn toward the front of the washing tub 12.

The basket 60 is withdrawn along the wheel 14 or the roller device 100 to receive the tableware and pushed back into the washing tub 12, and then the tableware may be washed. When the washing of the tableware is completed, the basket 60 may be withdrawn through the front surface of the washing tub 12 and the washed tableware may be taken out.

The wheel 14 or the roller device 100 may be disposed between the washing tub 12 and the basket 60 so that the basket 60 may be supported by the washing tub 12. The wheel 14 or the roller device 100 may be coupled to the opposite sides of the basket 60.

The upper basket 60*a* may include the wheel 14 and the lower basket 60*b* may include the roller device 100. However, the disclosure is not limited thereto, and the upper basket 60*a* may also include the roller device 100 instead of the wheel 14.

Figure 3:
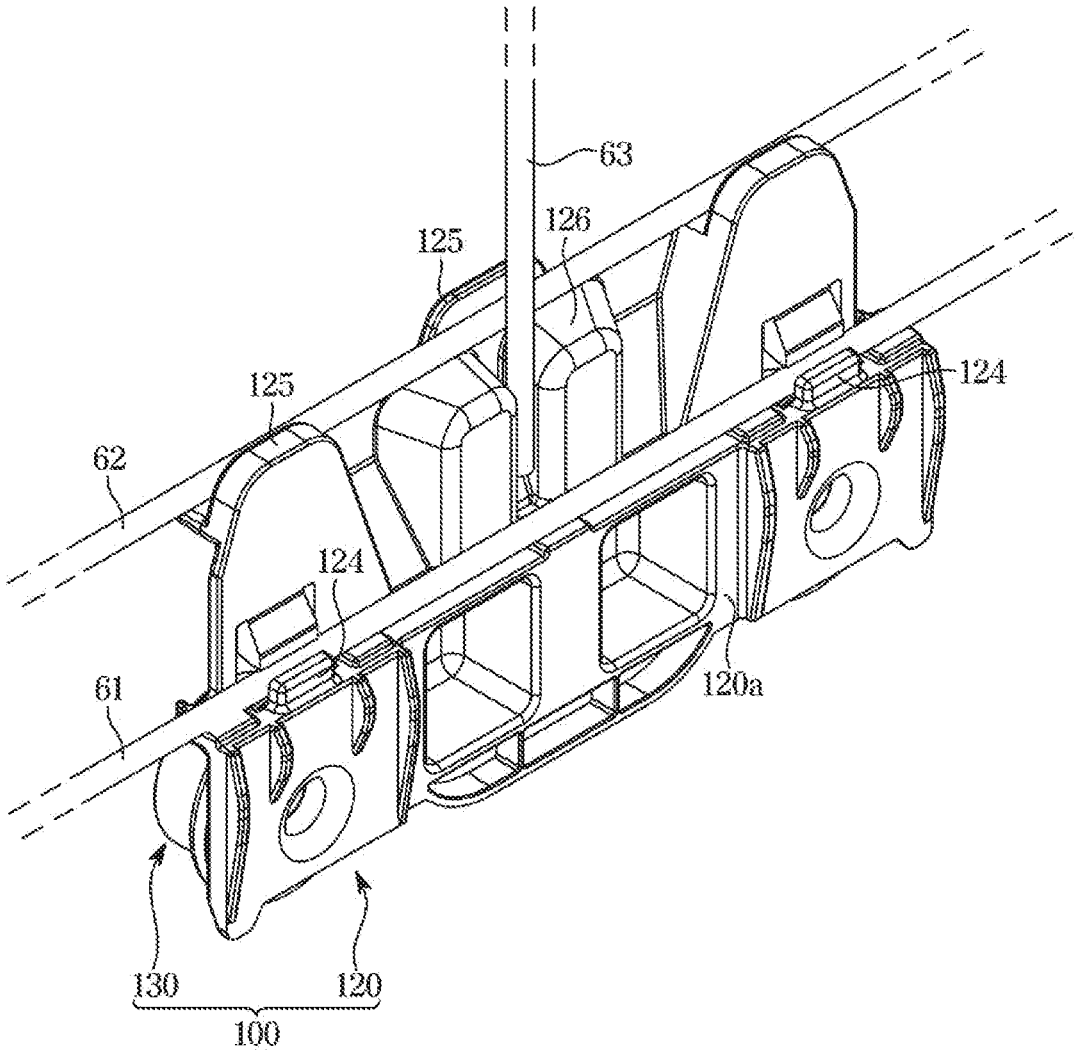
FIG. 3 is a view illustrating a roller device coupled to a basket in the dishwasher according to the disclosure.
Figure 4:
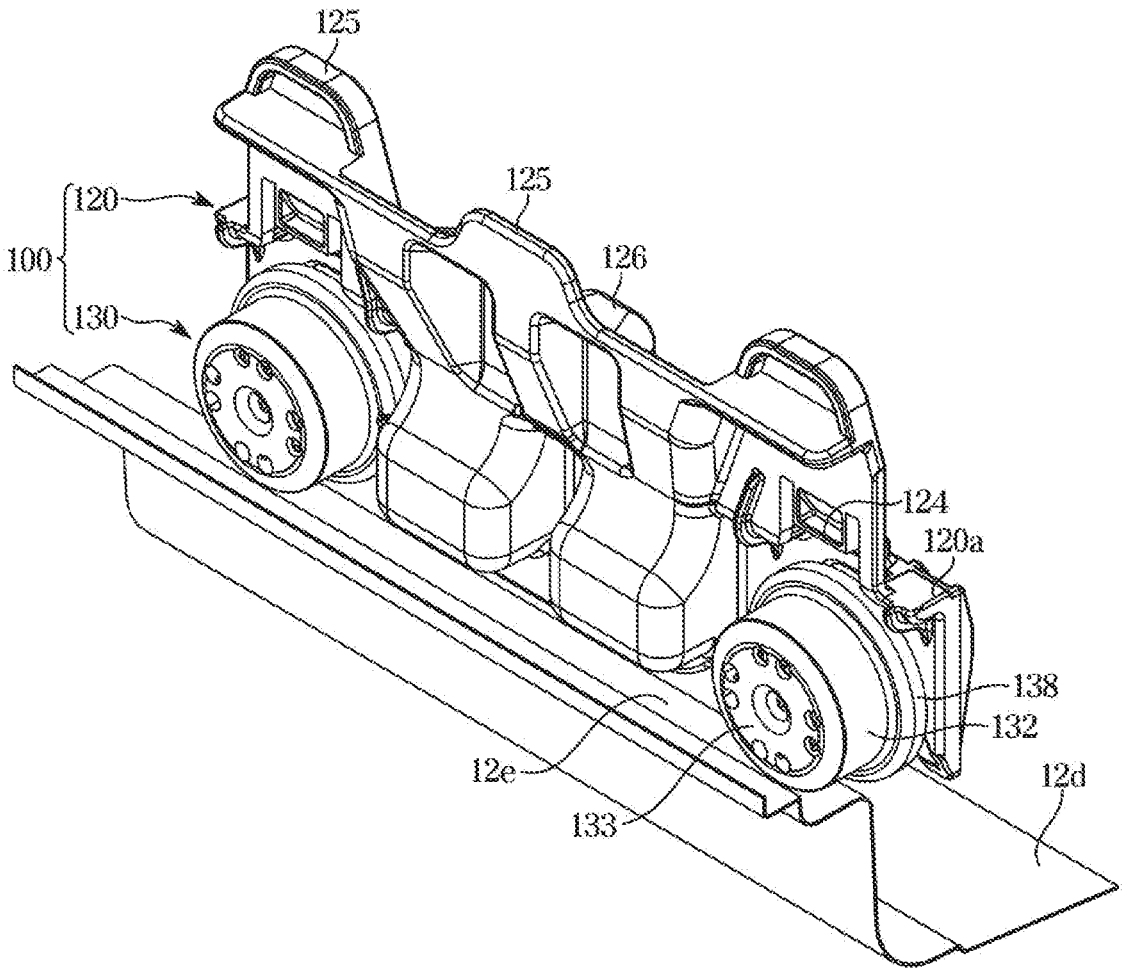
FIG. 4 is a view illustrating the roller device rolling along opposite sides of a lower plate in the dishwasher according to the disclosure.

FIG. 3 is a view illustrating a roller device coupled to a basket in the dishwasher according to the disclosure, and FIG. 4 is a view illustrating the roller device rolling along opposite sides of a lower plate in the dishwasher according to the disclosure.

As illustrated in FIGS. 3 and 4, the roller device 100 may include a shaft unit 120 coupled to the basket 60 (refer to FIG. 2), and a roller 130 rotatably coupled to a shaft 121 provided to allow the basket 60 to be withdrawn from the washing tub 12.

The shaft unit 120 may include a shaft body 120*a*, and a basket coupling portion 124 provided on the shaft body 120*a* to be coupled to one of the plurality of horizontally arranged horizontal wires 61 and 62 constituting the basket 60.

Two of the basket coupling portions 124 may be provided to be symmetrical to the shaft body 120*a*. However, the disclosure is not limited thereto.

The basket coupling portion 124 may have elasticity. The basket coupling portion 124 may include a ring shape with opened one side.

The one horizontal wire 61 of the plurality of horizontally arranged horizontal wires 61 and 62 constituting the basket 60 may be coupled to the basket coupling portion 124 through the opened one side of the elastic basket coupling portion 124.

However, the disclosure is not limited thereto, and the basket coupling portion 124 may include various shapes within a limit capable of coupling the shaft unit 120 to the basket 60.

The shaft unit 120 may include an anti-rotation portion 125 configured to interfere with the other horizontal wire 62 of the plurality of horizontal wires 61 and 62 to prevent the shaft unit 120 from rotating around the horizontal wire 61 coupled to the basket coupling portion 124.

A plurality of the anti-rotation portions 125 may be provided. The anti-rotation portion 125 may be provided in the vicinity of the basket coupling portion 124. The anti-rotation portion 125 may be provided above the basket coupling portion 124.

The anti-rotation portion 125 may prevent the shaft unit 120 from rotating in both directions around the horizontal wire 61 coupled to the basket coupling portion 124.

For example, one of the anti-rotation portion 125 may be disposed to interfere with one side of the horizontal wire 62 to prevent the shaft unit 120 from rotating in one direction, and two of the anti-rotation portions 125 may be disposed to interfere with the other side of the horizontal wire 62 to prevent the shaft unit 120 from rotating in the other direction.

However, the disclosure is not limited thereto, and the shape and number of the anti-rotation portions 125 may be variously provided within a limit capable of preventing the shaft unit 120 from rotating around the horizontal wire 61 coupled to the basket coupling portion 124.

The shaft unit 120 may include an anti-movement portion 126 configured to interfere with one of a plurality of vertically arranged vertical wires 63 constituting the basket 60 to prevent the shaft unit 120 from moving along the plurality of horizontal wires 61 and 62.

The vertical wire 63 may prevent the shaft unit 120 from moving in the front and rear directions by being inserted into a groove of the anti-movement portion 126.

The anti-movement portion 126 may be provided at the center of the shaft body 120*a*. However, the disclosure is not limited thereto, and the shape and number of the anti-movement portions 126 may be variously provided within a limit capable of preventing the shaft unit 120 from moving along the plurality of horizontal wires 61 and 62.

The roller 130 may include a wheel portion 132 configured to roll along the opposite side portions 12*e* of the lower plate 12*d* of the washing tub 12, and a stopper portion 138 forming a step outward from the wheel portion 132 to prevent the wheel portion 132 from being separated from the opposite side portions 12*e*.

The wheel portion 132 may roll along an upper surface of the opposite side portions 12*e*. As the wheel portion 132 according to the disclosure rolls along opposite side portions 12*e* of the lower plate 12*d*, a separate rail for the wheel portion 132 may not be included, thereby reducing the manufacturing cost.

The wheel portion 132 and the stopper portion 138 may include a cylindrical shape. The diameter of the cross section of the stopper portion 138 may be larger than the diameter of the cross section of the wheel portion 132. The stopper portion 138 may form a step outward from the wheel portion 132. The stopper portion 138 may extend outward along a radial direction from the wheel portion 132.

Thus, the stopper portion 138 interferes with the side surface of the opposite side portions 12*e* of the plate 12*d*, so that the wheel portion 132 from being separated from the opposite side portions 12*e* may be prevented.

Figure 5:
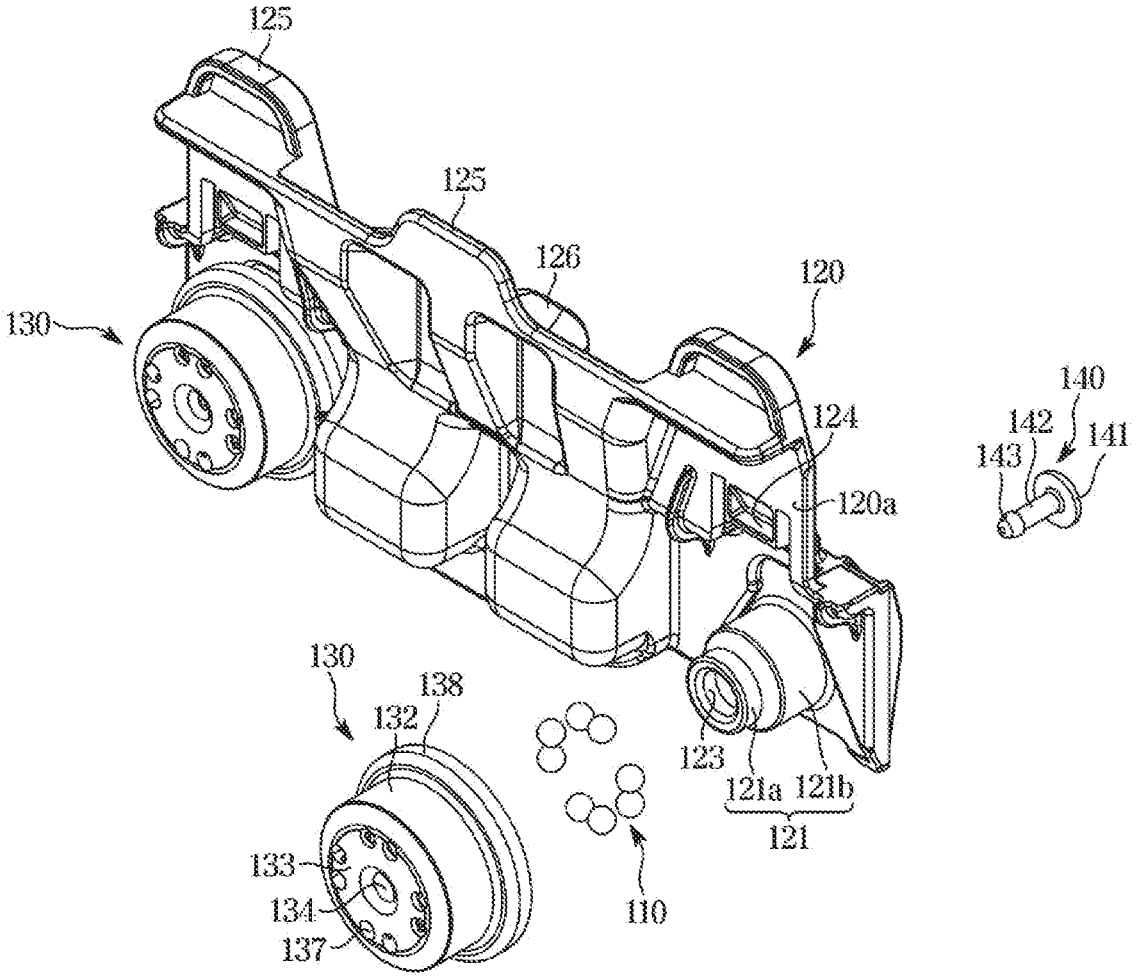
FIG. 5 illustrates an exploded perspective view of the roller device in the dishwasher according to the disclosure.
Figure 6:
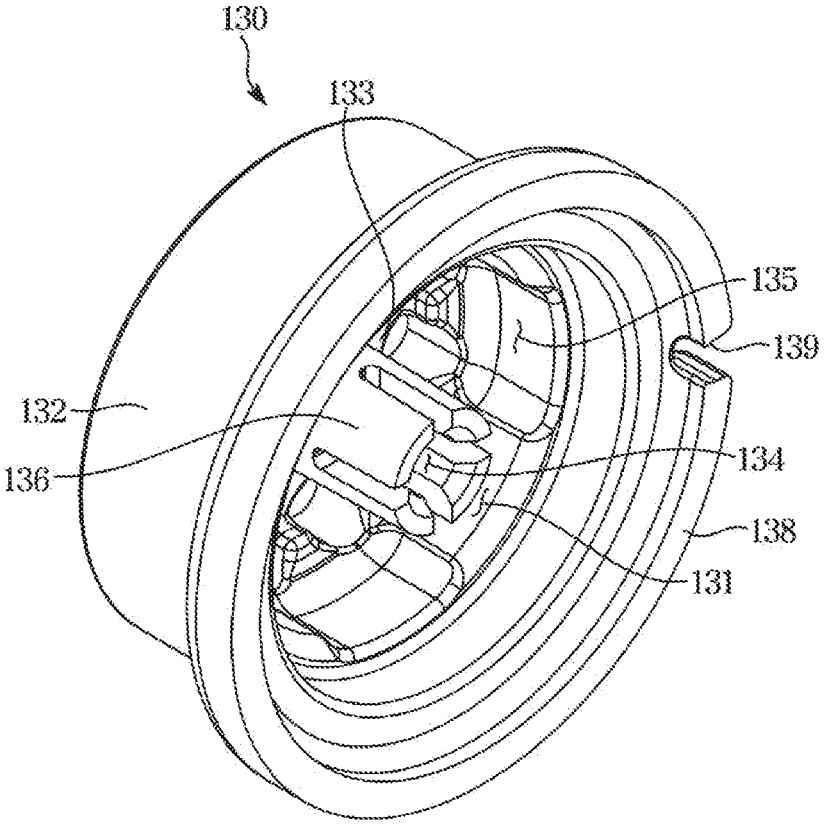
FIG. 6 is a view illustrating a roller in the dishwasher according to the disclosure.
Figure 7:
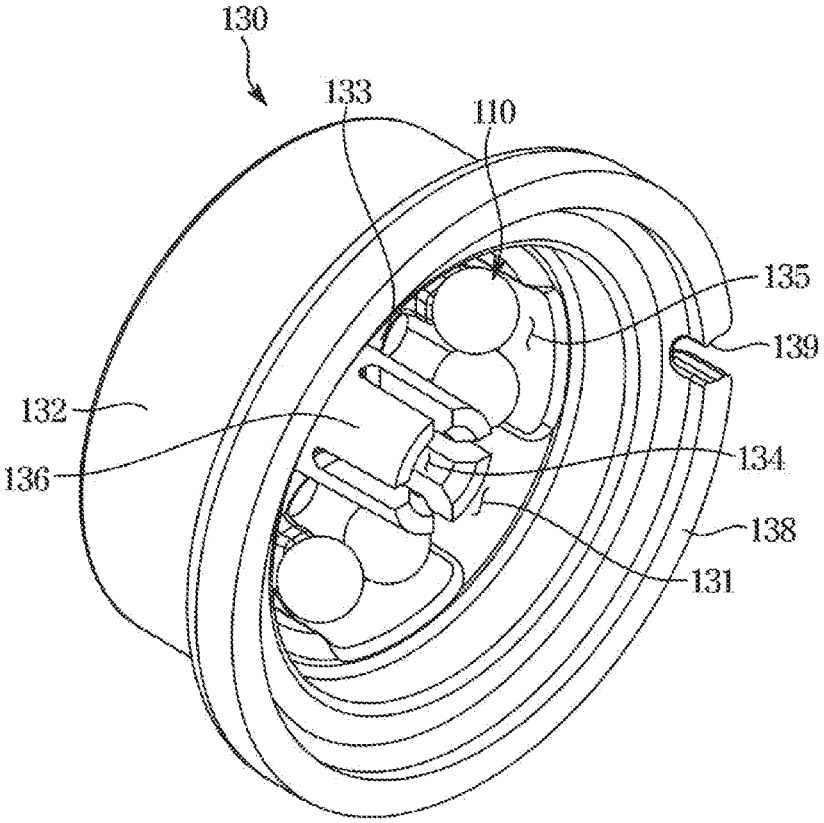
FIG. 7 is a view illustrating a state in which a plurality of balls is received in a seating portion of the roller in the dishwasher according to the disclosure.
Figure 8:
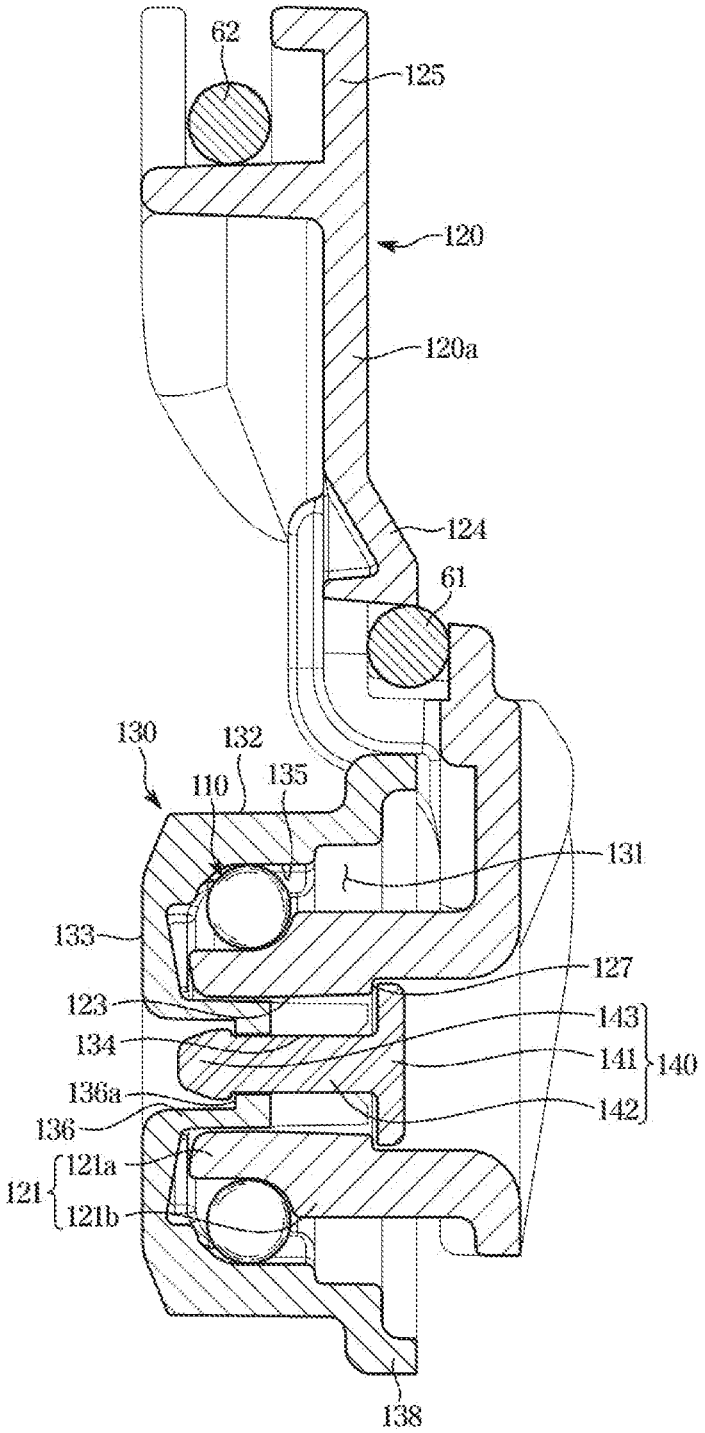
FIG. 8 illustrates a cross-sectional view of the roller device in the dishwasher according to the disclosure.

FIG. 5 illustrates an exploded perspective view of the roller device in the dishwasher according to the disclosure. FIG. 6 is a view illustrating a roller in the dishwasher according to the disclosure. FIG. 7 is a view illustrating a state in which a plurality of balls is received in a seating portion of the roller in the dishwasher according to the disclosure. FIG. 8 illustrates a cross-sectional view of the roller device in the dishwasher according to the disclosure.

As illustrated in FIGS. 5 to 8, the roller device 100 (see FIG. 4) may include a ball 110 provided such that the roller device 100 enables a rolling motion with a predetermined frictional force. A plurality of the balls 110 may be provided.

The number of the balls 110 is composed of eight, but the disclosure is not limited thereto. The number of balls 110 may be variously provided within a limit in which the roller device 100 enables the rolling motion with the predetermined friction force.

The roller device 100 may include a shaft unit 120 including the shaft 121 provided such that the ball 110 rotates along an outer circumferential surface thereof, and a roller 130 rotatably provided around the shaft 121.

The roller 130 may include a seating portion 135 provided to seat the ball 110. A plurality of the seating portions 135 may be provided to be spaced apart from each other.

The shaft 121 may include a first shaft 121*a* provided to allow the plurality of balls 110 to rotate, and a second shaft 121*b* forming a step outward from the first shaft 121*a* to prevent the plurality of halls 110 from being separated from the plurality of seating portions 135.

The first shaft 121*a* may include a cylindrical shape such that the plurality of balls 110 rotate in point contact with the first shaft 121*a*. An outer circumferential surface of the first shaft 121*a* with which the plurality of balls 110 is be in contact may form a straight line.

Therefore, as the shaft 121 according to the disclosure includes the first shaft 121*a* having a cylindrical shape, a groove for a separate raceway to allow the ball 110 to roll may be omitted, so that the shaft 121 may be easily taken out of a mold.

The shaft 121 may protrude from the shaft body 120*a* and may fixed to the shaft body 120*a* such that the plurality of balls 110 and the roller 130 rotate around the shaft 121. The shaft 121 may be integrally formed with the shaft body 120*a*.

Accordingly, in the roller device 100 according to the disclosure, the roller 130 and the plurality of balls 110 rotate around the shaft 121, while the shaft 121 may be fixed without rotating.

The roller 130 may be coupled to the shaft 121 to be rotatable about the shaft 121. The roller 130 may include a receiving portion 131 configured to receive the shaft 121.

The receiving portion 131 may receive the shaft 121 and the plurality of balls 110. The receiving portion 131 may be constituted by a bottom portion 133 and a wheel portion 132 bent from the bottom portion 133. The receiving portion 131 may have a shape in which one surface is opened by the wheel portion 132 and the bottom portion 133.

The ball 110 received in the receiving portion 131 may be positioned between the shaft 121 and the roller 130. The ball 110 may be positioned between an outer surface of the first shaft 121*a* and an inner surface of the wheel portion 132.

At least one of the plurality of seating portions 135 may receive two or more ones of the plurality of balls 110. FIG. 3 illustrates that two of the balls 110 are received in one of the seating portions 135, but the disclosure is not limited thereto.

For example, two or more of the balls 110 may be received in one of the seating portion 135.

The plurality of seating portions 135 is recessed outward from an inner circumferential surface of the wheel portion 132 and may constitute a groove opened in a direction of directing to the stopper portion 138 to prevent the plurality of balls 110 from being constrained to the plurality of seating portions 135.

That is, the plurality of seating portions 135 according to the disclosure may not include an undercut portion. Therefore, the roller 130 may be easily taken out from the mold.

In general, the plurality of balls 110 may not be spaced apart from each other, and all of the plurality of balls 110 may be continuously arranged and received in the receiving portion 131. In this case, however, because friction between the plurality of balls 110 may excessively affect the rolling performance of the roller 130 and the number of the balls 110 requires more than the number of the balls 110 when the plurality of balls 110 is spaced apart from each other, the manufacturing cost of the roller device 100 may increase.

Therefore, to solve this, the roller device 100 may include a retainer configured to allow the plurality of balls 110 to be spaced apart from each other in the receiving portion 131. However, when a separate retainer is added, the manufacturing cost of the roller device 100 may increase.

Accordingly, in the roller device 100 according to the disclosure, the seating portion 135 formed with the groove on an inner surface of the roller 130 may perform a retainer function without adding a separate retainer to the roller 130.

In addition, unlike the case where only one ball 110 is seated on one of the seating portion 135, two or more of the halls 110 are seated on one of the seating portion 135 of the disclosure, so that the rolling performance of the roller 130 may be greatly improved and the friction noise may be reduced.

The number of seating portions 135 according to the disclosure is four, but the disclosure is not limited thereto.

The roller 130 may include the bottom portion 133 bent from the wheel portion 132 to cover an outer side of the roller 130, and the bottom portion 133 may include a placement hole 137 configured such that the plurality of halls 110 is spaced apart from an inner surface of the bottom portion 133 and seated in the plurality of seating portions 135.

A plurality of placement holes 137 may be provided. Eight of the placement holes 137 are provided, but the disclosure is not limited thereto. The number of placement holes 137 may be variously provided within the number corresponding to the plurality of balls 110.

The placement hole 137 may be connected to the plurality of seating portions 135. One of the seating portion 135 may be connected to two of the placement holes 137. However, the disclosure is not limited thereto.

The ball 110 may be spaced apart from the bottom portion 133 and received inside the seating portion 135. The placement hole 137 may be configured to allow a separate lifting member, which is configured such that the ball 110 is spaced apart from the bottom portion 133 to penetrate, when the roller device 100 is seated in a separate assembly device in order to assemble the roller device 100.

The roller 130 may include a boss 136 configured to prevent the shaft 121 from being separated from the roller 130. The boss 136 may protrude from the bottom portion 133.

The boss 136 may protrude from the bottom portion 133 toward the shaft 121. The boss 136 may protrude from the bottom portion 133 in a direction in which the roller 130 is coupled to the shaft 121.

The shaft 121 may include an insertion hole 123 in which the boss 136 is inserted. The insertion hole 123 may include a hollow such that the boss 136 may be inserted.

The boss 136 may include a cylindrical shape. However, the disclosure is not limited thereto. One end of the boss 136 may be composed of four portions by being spaced apart from each other. The boss 136 may have a predetermined elastic force. However, the present disclosure is not limited thereto.

Therefore, the boss 136 may be easily inserted into the insertion hole 123 of the shaft 121.

The roller 130 may include a guide portion 139 provided to guide the roller device 101 when the roller device 100 is seated in the separate assembly device for assembly. A plurality of the guide portion 139 may be provided. The guide portion 139 may be provided at the stopper portion 138. However, the disclosure is not limited thereto.

The roller device 100 according to the disclosure may include a coupling member 140 to couple the roller 130 and the shaft 121.

Because the roller device 100 according to the disclosure does not include the raceway on the outer circumferential surface of the shaft 121 and the undercut portion of the seating portion 135 to facilitate taking out from the mold, coupling through a forced press between the shaft 121, the roller 130, and the plurality of balls 110 may be difficult.

Therefore, the roller device 100 according to the disclosure may couple the roller 130 and the shaft 121 through the separate coupling member 140.

The coupling member 140 may include a base portion 141, a body portion 142 protruding from the base portion 141, and a head portion 143 extending from the body portion 142. The base portion 141 may have a disk shape, the body portion 142 may have a cylindrical shape, and the head portion 143 may have a diameter larger than the diameter of the cross section of the body portion 142. However, the disclosure is not limited thereto.

The head portion 143 may extend outward from the body portion 142.

The boss 136 may include a coupling hole 134 into which the coupling member 140 is inserted. The shaft 121 may include the insertion hole 123 into which the boss 136 is inserted.

The boss 136 may include a head stopper **136*a* configured to catch the head portion 143 inserted into the coupling hole 134, and the shaft 121 may include a base stopper 127 configured to catch the base portion 141 inserted into the insertion hole 123**.

The head stopper **136*a* may have a diameter larger than the diameter of the coupling hole 134, and the base stopper 127 may have a diameter larger than the diameter of the insertion hole 123. The base stopper 127 may form a step outward from the insertion hole 123**.

Therefore as the base portion 141 is caught by the base stopper 127 and the head portion 143 is caught by the head stopper **136*a*, the roller 130 may be prevented from being separated from the shaft 121**.

Hereinafter the process of assembling the roller device 100 will be described.

First, the plurality of balls 110 may be received in the receiving portion 131 of the roller 130. Next, the roller 130 that receives the plurality of balls 110 may be seated in the separate assembly device.

In this process, the guide portion 139 of the roller 130 may easily guide the roller 130 to the assembly device.

When the roller 130 receiving the plurality of balls 110 is accommodated in the assembly device, the separate lifting member may be inserted through the placement hole 137 of the roller 130.

The plurality of balls 110 received in the receiving portion 131 may be positioned at a height corresponding to the seating portion 135 by the lifting member, and may be disposed in the seating portion 135 in a radial direction by a pneumatic pressure, a magnetic force, or the like of the assembly device.

Next, in a state where the positions of the plurality of balls 110 is maintained, the shaft 121 is inserted toward the roller 130 so that the boss 136 is inserted into the insertion hole 123, and the coupling member 140 is inserted into the insertion hole 123 of the shaft 121 and the coupling hole 134 of the boss 136 to couple the roller 130 and the shaft 121, thereby completing the assembly of the roller device 100.

Therefore, because the roller device 100 according to the disclosure may be easily assembled by the assembly device, the convenience of assembly may be improved and the manufacturing time of the roller device 100 may be shortened.

Figure 9:
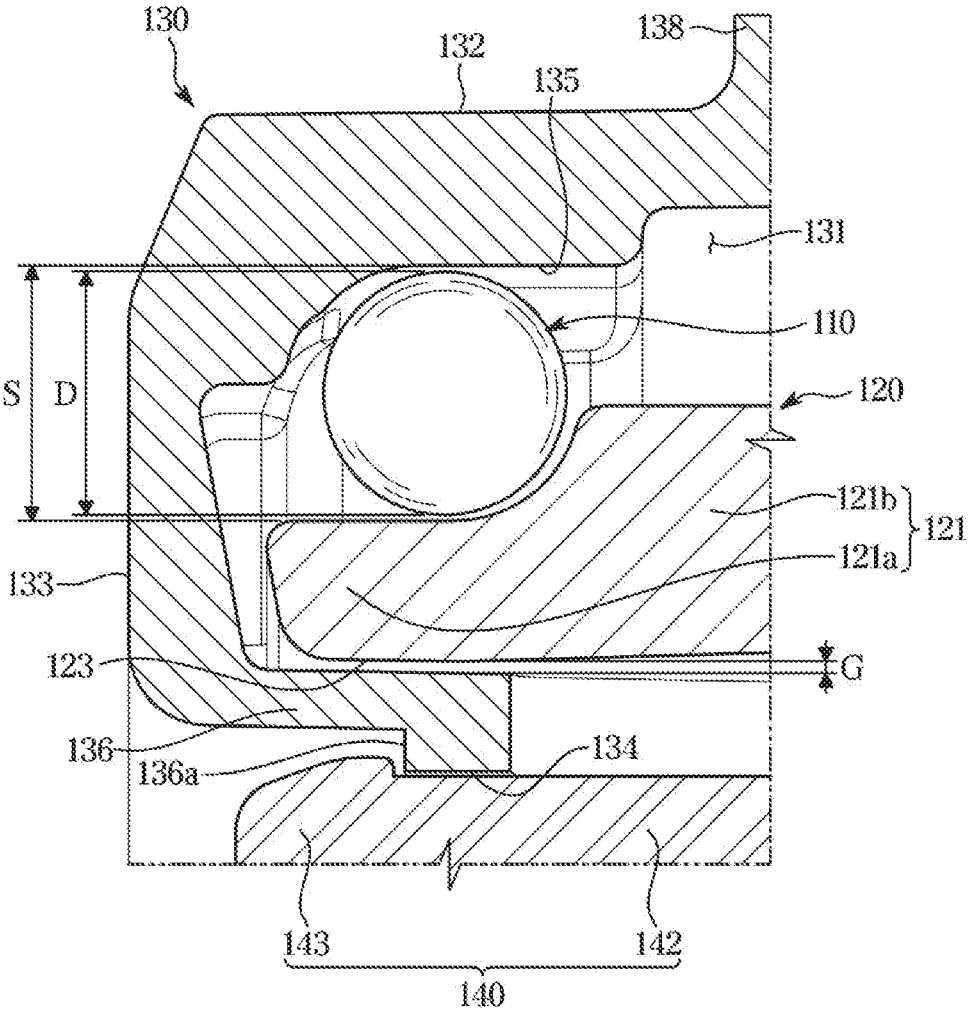
FIG. 9 illustrates an enlarged view of a portion of the cross section of the roller device illustrated in FIG. 8 in the dishwasher according to the disclosure.

FIG. 9 illustrates an enlarged view of a portion of the cross section of the roller device illustrated in FIG. 8 in the dishwasher according to the disclosure. As illustrated in FIG. 9, a gap G between an outer surface of the boss 136 and an inner surface of the insertion hole 123 is larger than a gap between the outer surface of the first shaft **121*a* and an inner surface of the plurality of seating portions 135 and the plurality of balls 110 seated in the plurality of seating portions 135**.

That is, the gap G between an outer surface of the boss 136 and the inner surface of the insertion hole 123 is larger than a value obtained by subtracting a diameter D of the ball 110 from a gap S between the outer surface of the first shaft **121*a* and the inner surface of the seating portion 135**.

The ball 110 received in the seating portion 135 may be spaced apart from the roller 130 or the shaft 121 by a predetermined distance to enable rolling motion.

Due to the gap between the ball 110, the roller 130, and the shaft 121, when the roller device 100 is twisted by an external force, the plurality of balls 110 may be separated from the seating portion 135.

Therefore, to prevent this, the roller 130 according to the disclosure may include the boss 136 inserted into the insertion hole 123.

When the roller device 100 is twisted by the external force, the boss 136 is caught by the interference with the insertion hole 123, thereby preventing the plurality of balls 110 from being separated from the seating portions 135.

As is apparent from the above, the disclosure can improve the convenience of use by enhancing the rolling performance of a roller.

The disclosure can reduce the manufacturing cost of a roller device by the roller being provided with a seating portion capable of performing a retainer function together.

The disclosure can prevent a plurality of balls from being separated from the rollers and a shaft by an external force by improving such that the roller, the plurality of balls, and the shaft are firmly coupled to each other.

The technical spirit of the disclosure has been described above, but the scope of the disclosure is not limited thereto.

It will be understood by those of skilled in the art that various changes in form and details may be made without departing from the spirit and scope of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A dishwasher comprising:

a cabinet including a washing tub;

a basket provided inside the washing tub, comprising:

a plurality of horizontal wires; and a plurality of vertical wires;

a shaft unit coupled to the basket and including a shaft;

a plurality of balls rotating along an outer circumferential surface of the shaft;

a roller rotatably coupled to the shaft and including a plurality of seating portions spaced apart from each other to seat the plurality of balls; and a coupling member configured to connect the roller and the shaft, wherein at least one of the plurality of seating portions receives two or more of the plurality of balls, wherein the two or more balls are disposed adjacent to each other without a separator therebetween in the at least one seating portion.

2. The dishwasher according to claim 1, wherein the shaft includes:

a first shaft configured to allow the plurality of balls to rotate; and a second shaft having a step outward from the first shaft to prevent the plurality of balls from being separated from the plurality of seating portions.

3. The dishwasher according to claim 2, wherein the first shaft includes a cylindrical shape such that the plurality of balls rotates in point contact with the first shaft.

4. The dishwasher according to claim 2, wherein an outer circumferential surface of the first shaft in contact with the plurality of balls forms a straight line.

5. The dishwasher according to claim 1, wherein the roller further includes:

a wheel portion configured to roll along opposite side portions of a lower plate of the washing tub; and a stopper portion forming a step outward from the wheel portion to prevent the wheel portion from being separated from the opposite side portions.

6. The dishwasher according to claim 5, wherein the plurality of seating portions are recessed outward from an inner circumferential surface of the wheel portion and constitute a groove opened in a direction of directing to the stopper portion to prevent the plurality of balls from being constrained to the plurality of seating portions.

7. The dishwasher according to claim 5, wherein:

the roller further includes a bottom portion bent from the wheel portion to cover an outer side of the roller, the bottom portion includes a placement hole configured such that the plurality of balls is spaced apart from an inner surface of the bottom portion and seated in the plurality of seating portions.

8. The dishwasher according to claim 7, wherein the placement hole is connected to the plurality of seating portions.

9. The dishwasher according to claim 7, wherein the coupling member includes:

a base portion;

a body portion protruding from the base portion; and a head portion extending from the body portion.

10. The dishwasher according to claim 9, wherein the roller further includes a boss including a coupling hole into which the coupling member is inserted.

11. The dishwasher according to claim 10, wherein the shaft includes an insertion hole into which the boss is inserted.

12. The dishwasher according to claim 11, wherein:

the boss includes a head stopper configured to catch the head portion inserted into the coupling hole, the shaft includes a base stopper configured to catch the base portion inserted into the insertion hole.

13. The dishwasher according to claim 11, wherein a gap between an outer surface of the boss and an inner surface of the insertion hole is larger than a gap between an outer surface of the shaft and an inner surface of the plurality of seating portions and the plurality of balls seated in the plurality of seating portions.

14. The dishwasher according to claim 1, wherein:

the shaft unit further includes a shaft body coupled to the basket, the shaft protrudes from the shaft body and is fixed to the shaft body such the plurality of balls and the roller rotate around the shaft.

15. The dishwasher according to claim 1, wherein the shaft unit further includes:

a basket coupling portion configured to be coupled to a first horizontal wire of the plurality of horizontal wires;

an anti-rotation portion configured to interfere with a second horizontal wire of the plurality, of horizontal wires to prevent the shaft unit from rotating around the first horizontal wire coupled to the basket coupling portion; and an anti-movement portion configured to interfere with one of the plurality of vertical wires to prevent the shaft unit from moving along the plurality of horizontal wires.

16. A dishwasher comprising:

a cabinet including a washing tub;

a basket provided inside the washing tub; and a roller device configured to withdraw the basket from the washing tub, wherein the roller device includes:

a shaft unit including a shaft;

a plurality of balls configured to rotate along an outer circumferential surface of the shaft;

a roller, including:

a wheel portion configured to be rotatable about the shaft; and a plurality of seating portions, each seating portion having an opened end to prevent the plurality of balls from being constrained and recessed outward from an inner circumferential surface of the wheel portion, wherein at least one of the plurality of seating portions receives two or more of the plurality of balls, wherein the two or more balls are disposed adjacent to each other without a separator therebetween in the at least one seating portion; and a coupling member configured to connect the roller and the shaft, and wherein the outer circumferential surface of the shaft in contact with the plurality of balls forms a straight line.

17. The dishwasher according to claim 16, wherein the plurality of seating portions are provided to be spaced apart from each other.

18. A roller device comprising:

a plurality of balls;

a shaft unit including a shaft including a cylindrical shape such that the plurality of balls rotate along an outer circumferential surface thereof;

a roller rotatably coupled to the shaft and including a plurality of seating portions spaced apart from each other to seat the plurality of balls; and a coupling member configured to connect the roller and the shaft, wherein two or more of the plurality of balls are seated adjacent to each other without a separator therebetween in each of the plurality of seating portions, respectively.

19. The roller device according to claim 18, wherein:

the roller further includes a boss including a coupling hole into which the coupling member is inserted, the shaft further includes an insertion hole into which the boss and the coupling member are inserted.

* * * * *